United States Patent [19]

Baltrus et al.

[11] Patent Number: 4,903,084

[45] Date of Patent: Feb. 20, 1990

[54] CLEANING APPARATUS HAVING AN INTERFERENCE-FIT HOUSING

[75] Inventors: Leon A. Baltrus, Pittsford; Clyde M. Creveling, Rochester; Donald G. McKeown, Warsaw; Thomas E. Reding, South Byron; David L. Thompson, Henrietta; Francisco L. Ziegelmuller, Greece, all of N.Y.

[73] Assignee: Eastman Kodak Company, Rochester, N.Y.

[21] Appl. No.: 327,850

[22] Filed: Mar. 23, 1989

Related U.S. Application Data

[63] Continuation-in-part of Ser. No. 132,841, Dec. 14, 1987, abandoned.

[51] Int. Cl.[4] ..... G03G 21/00

[52] U.S. Cl. ..... 355/301; 15/308; 355/215

[58] Field of Search ..... 355/215, 296, 301, 303; 15/1.5, 256.51, 256.52, 301, 308, 309; 118/652

[56] References Cited

U.S. PATENT DOCUMENTS

| | | | |
|---|---|---|---|
| 3,278,972 | 10/1966 | Hudson | 355/302 X |
| 3,795,025 | 3/1974 | Sadamitsu | 355/304 X |
| 3,942,889 | 3/1976 | Kurita et al. | 355/303 |
| 3,965,524 | 6/1976 | Kurita et al. | 355/298 X |
| 4,014,065 | 3/1977 | Hudson | 355/296 X |
| 4,205,911 | 6/1980 | Dole | 355/298 |
| 4,304,026 | 12/1981 | Borostyan | 355/297 X |
| 4,364,660 | 12/1982 | Oda | 355/297 |
| 4,459,012 | 7/1984 | Allen et al. | 355/304 |
| 4,538,321 | 9/1985 | Binder et al. | 355/296 |
| 4,681,426 | 7/1987 | Bean et al. | 355/298 |

*Primary Examiner*—Fred L. Braun

*Attorney, Agent, or Firm*—Tallam I. Nguti

[57] ABSTRACT

The inner diameter of a single and compact external dusthood that houses the fiber brush of a brush-vacuum cleaning apparatus, is made to be substantially less than the average outer diameter of such fiber brush, thereby creating a substantial interference fit of the brush with the inside of such an external dusthood. The substantial interference contact between the brush and the inside of the external dusthood is such that any open or free air passage ways or air pockets between the brush and the external dusthood are eliminated, and such that toner particles removed by the brush from an image bearing surface are immediately entrained and carried (through the external dusthood) against the inside wall of such external dusthood, thereby preventing such particles from ever becoming airborne, or building up anywhere within the external dusthood.

5 Claims, 3 Drawing Sheets

CLEANING APPARATUS HAVING AN INTERFERENCE-FIT HOUSING

RELATED APPLICATION

This is a continuation-in-part of U.S. application Ser. No. 07/132,841, entitled "CLEANING APPARATUS HAVING AN INTERFERENCE-FIT HOUSING", filed December 14, 1987, now abandoned, in the names of A. Baltrus, Clyde M. Creveling, Donald G. McKeown, Thomas E. Reding, David L. Thompson, and Francisco L. Ziegelmuller, and commonly assigned.

BACKGROUND OF THE INVENTION

This invention relates to a brush-vacuum cleaning apparatus for removing residual toner particles from an image bearing surface in an electrostatographic copier or printer. More particularly, it relates to such an apparatus that is compact, simple, and improves cleaning by preventing the generation, as well as, the presence of airborne toner particles therein.

In electrostatographic copiers and printers that produce or reproduce images by employing reusable image bearing surfaces, the quality of the images obtained depends significantly on the ability to effectively clean such image bearing surfaces by removing residual toner and other particles therefrom.

Conventionally, fiber brush-vacuum cleaning apparatus, as disclosed, for example, in U.S. Pat. No. 3,278,972, issued October 1966 to Hudson, can be employed in cleaning such image bearing surfaces. In the belief that cleaning is enhanced, and out of concern for damage to the brush, the brush, which is rotatably housed in an external dusthood of such conventional apparatus, is usually spaced from the inside wall of such an external dusthood, thereby creating open or free air passage ways or air pockets between the brush and such external dusthood. Consequently, residual toner particles sweepingly removed from an image bearing surface by the rotating brush, intentionally or unintentionally, become airborne within such an external dusthood. Such airborne toner particles, or toner clouds, have a tendency to build up on the inside of the external dusthood from where they can break off in chunks and clog the vacuum source of such apparatus, as well as, a tendency to migrate, leak and contaminate sensitive components within the copier or printer in which such apparatus is being employed.

In such conventional brush-vacuum cleaning apparatus that generate airborne toner particles or toner clouds, attempts to prevent such contamination or such buildup undesirably involve the use of expensive, bulky and noisy vacuum sources, or the use of bulky external dusthoods that house multiple and often electrically biased components for the purpose of attracting and collecting the airborne toner particles they generate. Such attempts besides being costly and oftenly ineffective, are undesirable, especially in light of copiers and printers becoming smaller, more compact, and more competitive with regards to image quality.

SUMMARY OF THE INVENTION

It is, therefore, an object of the present invention to provide an improved brush-vacuum cleaning apparatus that prevents the generation, as well as, the presence of airborne toner particles therein.

It is another object of the present invention to provide an effective brush-vacuum cleaning apparatus that is compact and simple, and that includes only a single, compact external dusthood or housing, and that includes virtually no additional components therein for contacting the brush or for attracting and collecting airborne toner particles therein.

It is a further object of the present invention to provide a brush-vacuum cleaning apparatus that saves space, as well as, also prevents residual toner particles from becoming airborne within the apparatus by eliminating any open or free air passage ways or air pockets between the brush and an external dusthood that houses such brush.

Furthermore, it is an object of the present invention to eliminate toner particle buildup within the external dusthood or housing of a brush-vacuum cleaning apparatus, as well as, to eliminate toner particle contamination of sensitive components within a copier or printer using such an apparatus.

In accordance with the present invention, a brush-vacuum cleaning apparatus having a rotatable cleaning brush and a vacuum source, for removing residual toner particles from an image bearing surface in an electrostatographic copier or printer, includes (a) radially protruding brush fibers that form an average outer diameter of the brush, and (b) a single, compact external dusthood or housing which itself includes a front side opening, a backside opening spaced about 180° from the frontside opening for connection to the vacuum source, and a generally cylindrical inside wall of the external dusthood having an inner diameter substantially less than the average outer diameter of the brush, thereby creating a substantial interference fit of the brush with the inside wall of such an external dusthood.

In operation, the substantial interference fit of the brush with the inside wall of the external dusthood causes the protruding fibers of the rotating brush to be immediately deflected, substantially compressed, and then held in such a compressed state by the inside wall of the external dusthood, as the brush is rotated. As a consequence, toner particles sweepingly removed from the image bearing surface by the rotating fibers are immediately entrained and carried, sweepingly against the inside wall, from the frontside opening to the backside opening, thereby preventing the generation, as well, as the presence of airborne toner particles within the external dusthood.

Furthermore, the substantial interference fit of the brush within the external dusthood saves space, further prevents residual toner particles from becoming airborne within the external dusthood by eliminating any open or free air passage ways or air pockets between the brush and the external dusthood, and prevents any toner particle buildups inside the external dusthood due to the fibers of the brush continuously and sweepingly contacting and cleaning the inside wall of the external dusthood.

Other features and advantages of the present invention will become clear from the detailed description and the drawings of the preferred embodiment below.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENT

The present invention will now be described with reference to its preferred embodiment as used, for example, in an imaging loop 10 of a direct or reversal development electrophotographic copier or printer.

Figure 1:
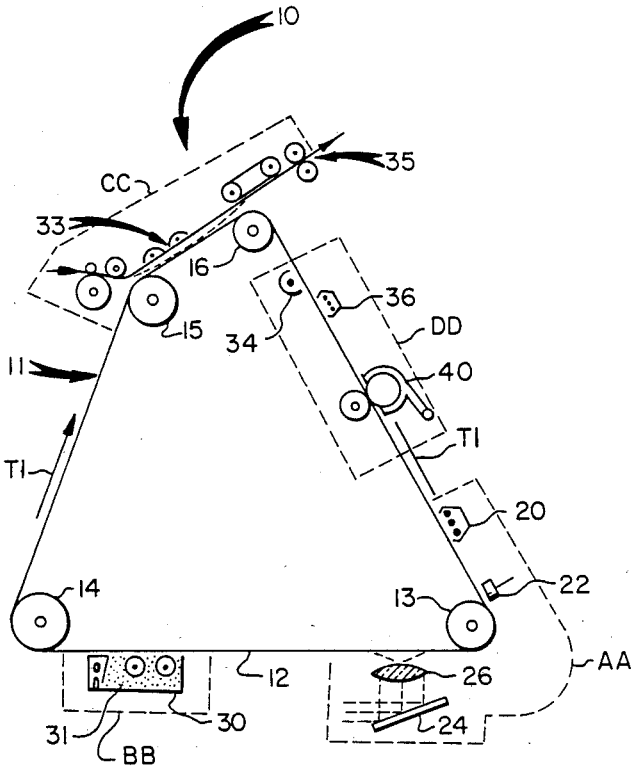
FIG. 1 is a schematic view of the image loop of an electrostatographic apparatus of the electrophotographic type incorporating a cleaning apparatus of the present invention.

Referring now to FIG. 1, the imaging loop 10 of such a copier or printer includes a reusable image bearing member 11, shown in the form of a continuous web, having an image bearing surface 12. Member 11 is trained about rollers 13 through 16 for movement in the direction indicated by the arrows T1 past a series of stages designated as AA, BB, CC and DD. The member 11 can also be a rigid drum.

For producing or reproducing images with such a copier or printer, clean and charge-free portions of the image-bearing surface 12 first move through the stage designated AA where a latent image is formed, for example, by charging the surface 12 using a primary charger 20, and then imagewise discharging portions of surface 12 using an electronic print head 22 and/or using an optical system. The optical system may include a light source (not shown) that illuminates a document sheet, with light rays from the sheet being reflected by a mirror 24 through a lens 26 to the surface 12.

Next, through the stage designated BB, the latent image is developed at a development station 30 using toner particles 31. At the stage designated CC, the toner image is transferred to a suitable receiver such as a copy sheet of paper, at a transfer station 33. The transferred image can then be fused to such receiver at a fusing station 35.

At the stage designated DD, any residual charges, on the portion of the surface 12 from which the toner image has just been transferred, are removed by a discharge lamp 34 and/or neutralized by a corona 36. To make sure that such a portion of the surface 12 is again clean, charge-free and ready for reuse, residual toner particles left thereon after the image transfer are effectively removed by the cleaning apparatus 40 of the present invention. The apparatus 40 is effective in removing the residual toner particles without such particles becoming airborne, and without such particles building up within the apparatus, or contaminating sensitive components within the copier or printer.

Figure 2:
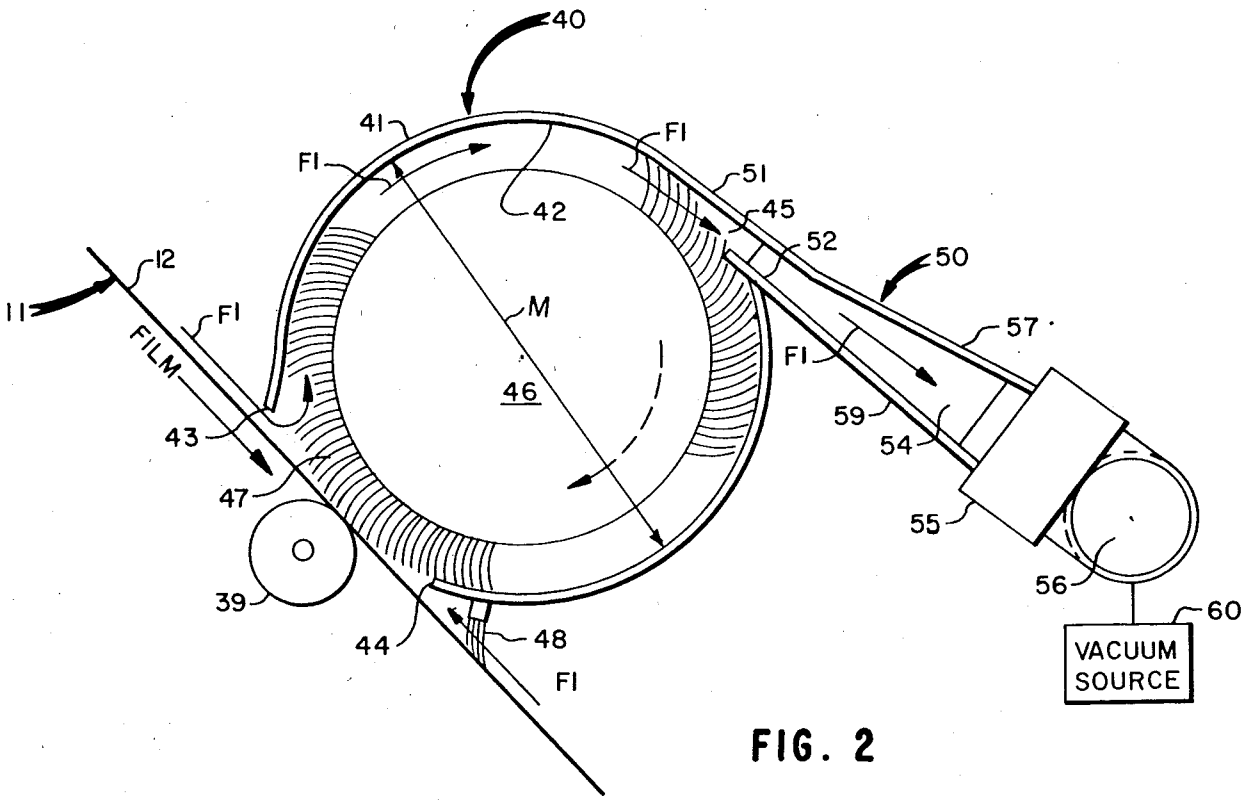
FIG. 2 is an enlarged schematic cross-sectional view of the present invention shown in contact with an image-bearing surface being cleaned.
Figure 3:
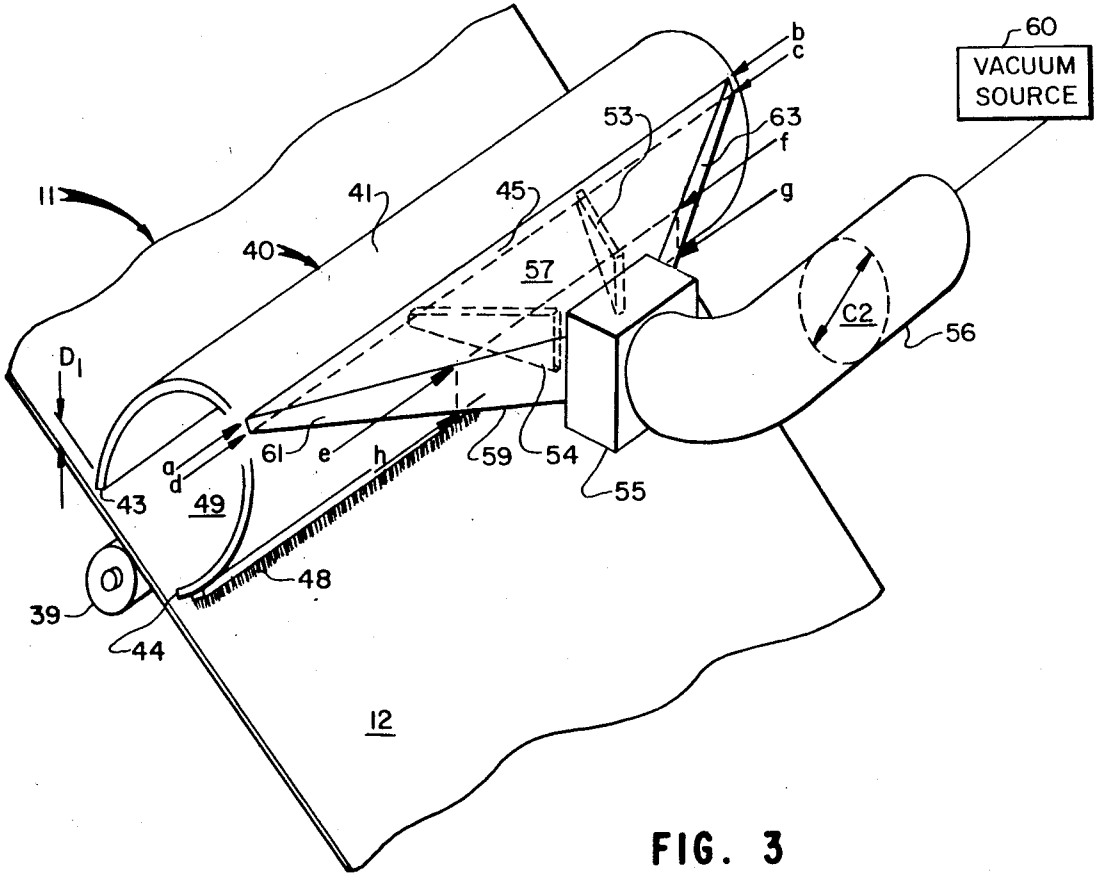
FIG. 3 is a perspective view of the FIG. 2 apparatus without the cleaning brush.

Referring now to FIGS. 2 and 3, the cleaning apparatus 40 includes a single, compact and elongate dusthood or housing 41 that is positioned adjacent the image bearing surface 12 of member 11, and which extends sufficiently across and beyond the full width of the surface 12. The apparatus 40 is positioned in front of, and spaced by a distance D1 from, the image-bearing surface 12 of member 11, at a point where the member 11 rides over a support roller 39.

The dusthood or housing 41 has a generally cylindrical inside wall 42 that has a diameter M and forms a chamber 49. Dusthood 41 also has a generally rectangular front side opening into the chamber 49 defined by edges 43, 44 which are generally parallel to surface 12. Dusthood 41 further includes a backside opening or slot 45 that is spaced circumferentially about 180° from the frontside opening. The slot 45 is preferably cut tangentially into dusthood 41 and forms a vacuum port to the chamber 49, thus linking the chamber 49 to a vacuum system that includes a vacuum source 60. The vacuum system operates to pull an airstream F1 through the spacing D1, the front side opening into the chamber 49, and out of the backside opening or slot 45.

The apparatus 40 also includes a cylindrical cleaning brush 46 that is positioned rotatably within the external dusthood or housing 41, such that it is substantially co-axial with the inside wall 42 of the dusthood. The outer surface of brush 46 is covered with radially protruding fibers 47 whose tips or free ends, when not deflected or compressed, form the average outer diameter (not shown) of the brush 46.

Unlike similar but conventional fiber brush and vacuum cleaning apparatus in which the brush, when mounted within the external dusthood or housing of the apparatus, is spaced from the inside wall of such external dusthood or housing, the brush 46 and external dusthood or housing 41 of the present invention are designed so as to create a substantial interference fit of the brush 46 within the dusthood 41. To accomplish this, the external dusthood 41 is made so that its inside diameter M is substantially less than the average outer diameter of the brush 46. Another way to express this relationship is that the average outer diameter of the brush is substantially greater than the diameter M of the inside wall 42 of the external dusthood 41. Furthermore, unlike similar but conventional fiber brush cleaning apparatus that include bulky external dusthoods or housings with multiple and often electrically biased components therein for variously contacting the brush, the present invention employs a single, compact external dusthood or housing 41, and virtually no additional components therein for contacting the brush.

When positioned within the external dusthood 41, the brush 46 can be rotated about its axis in a direction opposite to the direction of movement of the surface 12, or as shown, in a clockwise direction, by suitable drive means (not shown). When rotated as such, the fibers 47 extend through the frontside opening defined by edtes 43, 44 to contact and sweep against the surface 12, removing residual toner particles thereon.

Referring still to FIGS. 2 and 3, the apparatus 40 further includes a nozzle 50 having lips 51, 52. The nozzle 50 is fitted to, and projects into the chamber 49, as well as, tangentially from the backside opening or slot 45. The nozzle 50 connects the housing 41 to the vacuum source 60, through a connector 55 and a transport hose 56. As shown in FIG. 3, the nozzle 50 has a long, rectangular and narrow mouth or vacuum air inlet of cross-sectional area abcd, as defined in part by the lips 51, 52, and a generally cylindrical outlet into the connector 55.

Relative to the vacuum source connection at the slot 45, the lip 51 is the pre-vacuum lip, and it is aligned with, tangentially connected to, and follows from the inside wall 42 of the external dusthood 41. On the other hand, the lip 52 is the post-vacuum lip, and is parallel to, as well as, spaced from the lip 51. In addition, lip 52 projects beyond the inside wall 42, into the chamber 49, there it can contact and further interfere with the fibers 47 of the rotating brush 46. Such further interference with the rotating fibers 47 causes the fibers 47 to rub against one another, thereby loosening the residual toner particles entrained therein. The loosened toner particles are then free to move in, and with the airstream F1, as such airstream is pulled out of the external dusthood 41.

In order to prevent an open or free air pocket downstream of lip 52 wherein toner particles could become airborne or build up, the projection of lip 52 into the chamber 49 is made tangential to the tips or free ends of the rotating fibers 47, and its connection, to the inside wall 42 of the external dusthood 41, makes it virtually an extension of such inside wall 42 downstream of the slot 45. As such, the fibers 47 also contact and sweep against the downstream side of the projecting portion of the lip 52.

In pulling the airstream F1 out of the external dusthood 41, best results are obtained if a positive air velocity is maintained by the vacuum source 60 all the way back from the dusthood 41. To accomplish this, the nozzle 50 is made to have constant and equal cross-sectional areas from its lips 51, 52 up front, back to its connection with a connector 55. Similarly, the connector 55, and the vacuum hose 56 connecting it to the vacuum source 60, also have constant cross-sectional areas that are equal to those of the nozzle 50. For forming such cross-sectional areas, the nozzle 50 has tapering upper and lower walls 57, 59, respectively, and end walls 61 and 63. Walls 57, 59 diverge or flare away from each other starting from the lips 51, 52, and back to their union with the connector 55. The walls 57, 59 furthermore are narrower at the connector 55 than at the lips 51, 52, thereby causing the walls 62, 63 to converge or taper toward each other between th lips 51, 52 and the connector 55. Walls 61, 63, however, are wider at the connector 55 than at the lips 51, 52.

Because the structuring of the walls 57, 59, 61, 63 are such that the nozzle 50 has constant and equal cross-sectional areas from front to back, the area of the cross-section abcd at its mouth is therefore equal to the area of any of its cross-sections that is perpendicular to the axis of air flow from the slot 45 to the vacuum source 60. Thus, the cross-sectional area abcd is equal to cross-section area efgh near the connector 55.

Additionally, the operation of the nozzle 50 is enhanced by maintaining a uniform air velocity across the length of the vacuum port slot 45. To accomplish this, the nozzle 50 has flow guides 53, 54 located therein parallel to flow streams of air being pulled by the vacuum source 60 through the nozzle 50. Flow guides 53, 54 are so located preferably at positions approximately one-third and two-thirds the distance between end walls 61, 63 of nozzle 50. The guides 53, 54 also extend from a position closely adjacent slot 45, back to a point near, but spaced from, the connector 55.

To operate the cleaning apparatus 40, the vacuum source 60 is first activated to start pulling an airstream F1, as well as, any toner particles therein, through the fibers 47, and out the backside opening 45. The brush 46 is then turned on and rotated, for example, in such clockwise direction, to continuously contact a portion of the moving surface 12 and sweep residual toner and other particles therefrom into the fibers 47 and the airstream F1, as such portion of the surface 12 moves over the roller 39 between the edges 43, 44. The airstream F1 is pulled into and through the external dusthood 41 by the vacuum source 60 and the rotating fibers 47. The airstream F1, as it flows into the external dusthood 41, together with the rotating fibers, capture and carry with them, any toner particles removed sweepingly from the surface 12 by the fibers 47.

Because of the substantial interference fit of the brush 46 with the inside wall 42 of the external dusthood 41, the fibers 47, after sweepingly removing the residual toner particles from the surface 12, are immediately deflected, substantially compressed, and then held in such a substantially compressed state by the inside wall 42. As a consequence, the particles so removed from the surface 12 are immediately entrained in the fibers 47 against the wall 42, and there carried through the external dusthood 41, from the frontside opening to, and out of, the backside opening or slot 45.

Immediately entraining the swept-off particles in this manner effectively prevents such particles from ever becoming airborne within the external dusthood 41. The generation and presence of airborne toner particles inside the dusthood 41 is thus prevented. Additionally, the buildup of toner particles anywhere within the external dusthood 41 is also prevented, since due to the substantial interference fit of the brush 46 within the dusthood 41, the brush 46, as it is rotated, continuously contacts and sweeps against the inside wall 42 of the external dusthood 41, thereby cleaning such inside wall 42. Furthermore, the continuous sweeping contact of the fibers 47 against the wall 42 eliminates any open or free air passage ways or air pockets between the brush 46 and the inside wall 42 of the dusthood 41, thereby saving space, as well as, further preventing any toner particles from becoming airborne within such passage ways or pockets.

Consequently, the residual toner particles, removed from the surface 12, are carried by the airstream F1 completely entrained within the fibers 47, and thus are moved through the dusthood 41 in a fully contained and controlled manner, until they are taken out of the dusthood 41 at the slot 45. As such, risk of such toner particles becoming airborne and then reaching and contaminating other components of the imaging loop 10 is substantially prevented, and so is the risk of such toner particles building up within the external dusthood and possibly clogging the vacuum source 60. To further guard against contamination, any toner particles, removed from the surface 12 that fall out of the housing at the downstream edge 44 of the housing, will be trapped by a brush-screen 48, and thus will be prevented from reaching and contaminating the sensitive components adjacent the apparatus 40.

As is clear from the above description, the present invention, due to the substantial interference fit of the brush 46 with the inside wall 42 of the external dusthood 41, eliminates any open or free air passage ways or air pockets between the brush and the external dusthood, thereby saving space, and thereby substantially preventing the generation of airborne toner particles, as well as, the buildup of any such particles within the external dusthood 41. As a result, the risk of contamination due to airborne toner particles, and the risk of such particles clogging and rendering the cleaning apparatus ineffective, are eliminated. Additionally, the maintenance of a positive air velocity in the removal of residual toner particles from the external dusthood 41 is assured through the constant and equal cross-sectional area design of the nozzle 50. Overall, the apparatus 40 of the present invention assures continuous effective cleaning of the image-bearing surface 12, and because it includes only a single, compact external dusthood with virtually no additional components therein for variously contacting the brush, it is therefore also simple and very cost effective.

Although the present invention has been described in detail with particular reference to a preferred embodiment thereof, it will be understood that variations and modifications can be effected within the spirit and scope of the invention.

What is claimed is:

1. A cleaning apparatus for removing residual toner particles from an image bearing surface, said apparatus being of the type including a rotatable cleaning brush for sweepingly removing residual toner particles from the image bearing surface, an external dusthood or housing substantially surrounding the brush, a vacuum source for moving air into, through and out of the dusthood or housing, and some means within the external dusthood or housing for contacting the bursh, the improvements comprising:

(a) radially protruding fibers on the brush, said fibers having free ends forming an average outer diameter of the brush; and (b) a single external dusthood or housing including (i) a frontside opening through which said fibers can extend to sweepingly remove toner particles from the image bearing surface, (ii) a backside opening connected to th vacuum source, and spaced about 180° from said frontside opening; and (iii) a generally cylindrical inside wall, said inside wall having an inner diameter substantially less than said average outer diameter of the brush, so as to create a substantial interference fit of said fibers of the brush with said inside wall of said external dusthood, whereby said fibers, after sweeping and removing toner particles from the image bearing surface, are immediately deflected, substantially compressed, and then held in such a compressed state by said inside wall of said external dusthood, and whereby such toner particles are immediately entrained by said fibers against said inside wall, thereby preventing such toner particles from ever becoming airborne within said external dusthood.

2. The cleaning apparatus of claim 1 wherein said interference fit of said fibers of the brush with said inside wall of the external dusthood is such that said substantially deflected and compressed fibers of the brush continuously contact and sweep against said inside wall, thereby saving space, eliminating any open or free air passage ways or air pockets between the brush and said external dusthood, and further preventing the presence or buildup of airborne toner particles within said external dusthood.

3. The cleaning apparatus of claim 1 further including a nozzle connecting said backside opening to the vacuum source, said nozzle having an upstream lip and a downstream lip relative to the rotation of said fibers of the brush, said downstream lip of said nozzle projecting into said inside wall of said external dusthood to contact and further interfere with said fibers of the brush.

4. The cleaning apparatus of claim 3 wherein said downstream lip of said nozzle, in order to prevent an open or free air pocket behind said lip where toner particles could build up or become airborne downstream of said backside opening, projects into said inside wall tangentially to said free ends of said rotating fibers of the brush within said external dusthood.

5. The cleaning apparatus of claim 3 wherein said nozzle includes a generally rectangular vacuum air inlet formed in part by said upstream and downstream lips, and a generally cylindrical vacuum air outlet, said inlet and said outlet having constant and equal cross-sectional areas, and said inlet and said outlet being connected by a first wall attached to said upstream lip, a second wall attached to said downstream lip and two side walls joining said first and second walls together, said side walls tapering from said inlet to said outlet, and said first and second walls flaring from said inlet to said outlet in order to maintain said constant and equal cross-sectional areas.

* * * * *